United States Patent [19]

Ellis

[11] Patent Number: 4,645,466

[45] Date of Patent: Feb. 24, 1987

[54] SURFBOARD USER'S FOOT PIECE AND NEW COMBINATIONS THEREWITH

[76] Inventor: Dale E. Ellis, 5200 Montague St., Orlando, Fla. 32808

[21] Appl. No.: 773,603

[22] Filed: Sep. 9, 1985

[51] Int. Cl.[4] ..... A63C 15/06

[52] U.S. Cl. ..... 441/74; 2/DIG. 6; 24/445; 24/450; 36/132; 114/39

[58] Field of Search ..... 441/74; 114/39.2; 24/306, 442, 445, 450, 452, 451; 36/7.7, 116, 132; 2/DIG. 6; 280/11.3

[56] References Cited

U.S. PATENT DOCUMENTS

| | | | |
|---|---|---|---|
| 3,075,307 | 1/1963 | Becker | 36/7.7 |
| 3,914,882 | 10/1975 | Greer | 36/7.7 X |
| 4,285,082 | 8/1981 | Cox | 441/74 |
| 4,298,210 | 11/1981 | Lotteau et al. | 280/11.3 X |

FOREIGN PATENT DOCUMENTS

| | | | |
|---|---|---|---|
| 977532 | 11/1975 | Canada | 24/451 |

*Primary Examiner*—Sherman D. Basinger

*Assistant Examiner*—Paul E. Salmon

*Attorney, Agent, or Firm*—Roger L. Martin

[57] ABSTRACT

An improved foot piece for use with a surfboard type water craft that has a flat top surface which is equipped with a loop bearing surface component having a generally planar outwardly and upwardly facing surface portion with a multitude of small, closely spaced, flexible loop elements has one or more flat flexible surface components with an outwardly facing surface portion that is equipped with a multitude of small, stiff, closely spaced and outwardly projecting linear elements. The flexible surface components are fixed to the outside surface of the foot piece, preferably to both the bottom and side surface portions that underlie the sole and are at the instep side of a user's foot in the foot piece. The linear elements become engaged by the loop elements when the generally planar surface portion bears against the outwardly facing surface portion of the flexible components so that movements of the foot piece in parallel with the top surface is resisted whereas withdrawal of the foot piece from the top surface of the surfboard is not resisted.

10 Claims, 4 Drawing Figures

SURFBOARD USER'S FOOT PIECE AND NEW COMBINATIONS THEREWITH

This invention relates to an improved foot piece for use in riding surfboards and surfboard-type water craft such as sailboards and to new combinations therewith.

BACKGROUND OF THE INVENTION

Those acquainted with the use of surfboards and sailboards are well aware of the efforts needed to maintain an upright standing position during use of such boards as well as with the dangerous consequences that accompany the loss of ones balance. The boards are typically made of plastic material that is reinforced with fiberglass and the top surface is substantially flat and often downwardly tapering or sloping toward the lateral edges. This top surface is normally smooth because of the materials and techniques used in the construction of the boards and which are primarily directed at providing a minimum resistance to the flow of water in the aqueous environment of use. In this use environment, these materials and techniques result in a slick or slippery support surface for the surfer and are the proximate cause of many of the injuries that are encountered by surfers during the use of such craft.

Various approaches have been taken to provide a safer support surface on such crafts. In some situations, the top surfaces have been modified to provide a rough surface akin to that found on sandpaper. These modifications lessen slippage but are uncomfortable to stand on and soon wear the calluses off the soles of the surfer's feet. In addition, much of the surfer's time is spent in a prone position on the surfboard, either paddling out for the next ride or awaiting the arrival of the next sizable wave. Needless to say, the abrasiveness of such roughened surfaces causes wear and tear on all parts of the body that come into contact therewith and, as such, surfaces of this nature are totally unacceptable in the environments in which such water craft are used.

The most recent approach to a solution to the slick or slippery surface problem has involved the use of so-called hook- and loop-type fasteners. Fasteners of this nature have been manufactured by Velcro USA Inc. in Manchester, N.H. for several years and are sold under the brand name of VELCRO. Such fasteners consist of two components with respective facial surface portions that are first arranged to confront and then brought to bear against each other when the fastening relation is established. The facial surface portion of one component is equipped with a multitude of loop elements and the facial surface portion of the other component is equipped with a multitude of hook elements. When the facial surface portions are brought together the hook-type elements of the one component become entangled with and are engaged by the loop elements of the other component. This establishes the fastening relation between the components.

In practice, when attempts are made to separate the fastener components, a high resistance to the separation results when the confronting surface portions are maintained in a parallel relation such, for example, as when the components are fixed to facially confronting flat planar rigid surfaces of individual members that are fastened together by means of the components.

On the other hand, the resistance to the separation of the components is substantially diminished if one of the components is flexible and thus capable to bending during the separation process. This flexibility permits the component to be peeled away from the surface of the other component. In effect, the diminished resistance is attributable to the fact that the separation forces are only resisted by the coupling between the hook and loop elements along the parting line between the confronting surface portions of the components as the one component is being peeled away from the other.

The use of hook-and loop-type fasteners in conjunction with surfboards and similar types of water crafts is illustrated in U.S. Pat. No. 4,285,082 granted to Cox. Basically, strips of one of the fastener components are applied to the top surface of the board while one or more strips of the other fastener component are applied to the bottom surface of a foot piece that is worn by the user of the board. Either one of the hook- or loop-type components of the fastener may be applied to the surfboard so long as the other type component is applied to the foot piece. In practice, the component equipped with the loop elements is applied to the top surface of the board because it is the least abrasive to the user's skin.

The use of the hook-and loop-type fastening components on the surfboard and foot pieces worn by the surfer enables the surfer to attain a relatively secure footing while riding the craft from a standing position. The entanglement of the hook elements by the loop elements prevents the surfers foot piece from slipping on the top surface of the board or otherwise moving in parallel with the top surface unless a substantially complete separation of the fastening components is realized before the parallel movement transpires.

There are certain problems associated with the use of the hook-and loop-type fasteners for deterring slippage on the water craft, the main problem being that associated with the relocation of the surfer's feet on the surfboard as the need arises to shift the surfer's weight in response to a changing profile of the water surface. In practice, a shift in position is commonly initiated either by lifting the heal of the foot piece and rolling the foot piece forwardly toward it's toe so as to peel the fastener components on the foot piece away from those at the top surface of the surfboard or, by rolling the foot piece laterally and usually away from the instep so as to again peel the fastener components on the foot piece away from those at the top surface of the surfboard. The forward rolling movement meets with the least resistance to the separation of the fastener components because the parting line during the separation process is usually shorter than that encountered for reasons of a lateral rolling movement.

It is the resistance to the separation of the fastener components that creates the problems. With the rapidly changing water surface conditions encountered in the surfing environment, there is very little time to adjust to a changing condition that requires movement and relocation of the surfer's feet. At times a quick lateral or forward movement of one foot is required to adjust to a changing condition whereas at other times immediate relocation of both feed is needed. The resistance offered by the hoop-and loop-type fasteners to the separation or withdrawal of the foot piece from the top surface of the board and the requirement for special movements to release the fasteners are the principal reasons why such fasteners have not become widely used in the surfing industry. The fasteners, although solving the slippage problems nevertheless interfere with the user's mobility and thus the surfers ability to spontaneously and effectively manipulate the surfboard.

SUMMARY OF THE INVENTION

In accord with the invention, an improved foot piece for surfer's is provided with one or more flexible components at its outside surface and which have an outwardly facing surface portion with a multitude of small, stiff, closely spaced, outwardly projecting and generally straight linear elements. The foot piece is especially adapted for use by surfers with surfboard-type water craft that have a flat top surface which is equipped with one or more surface components that have a generally planar, upwardly and outwardly facing surface portion with a multitude of small, closely spaced, flexible loop elements, such as exemplified by the loop components of the fasteners referred to above. The flexible components of the foot piece are free of hook-type elements and each of the linear elements of the flexible components has a substantially uniform diametric dimension throughout its entire length of outward projection.

In the environment contemplated, when the flexible component of the foot piece is brought to bear against the surface component of the water craft, the linear elements at the outwardly facing surface portion of the surface component of the foot piece become engaged by the loop elements of the loop bearing surface component of the surfboard and movements of the foot piece in parallel with the top surface of the water craft are resisted. On the other hand, and by virtue of the generally straight nature of the linear elements and the absence of hook elements in the structure of the flexible components of the foot piece, resistance to the separation of the components is practically nonexistent as the foot piece is vertically withdrawn from the top surface of the craft for purposes of relocation. This ability to withdraw the surfer's foot from the surface of the water craft without encountering resistance to such movements greatly facilitates the manipulation of such craft by the surfer and substantially reduces the number of so-called "wipe-outs" which occur for reasons of a slow response to changing surface water conditions.

In accord with certain aspects of the invention, one or more of the flexible components with the linear elements are fixed to the foot piece along a bottom surface which underlies the sole of the user's foot. In this position on the foot piece, the linear elements of the flexible component are arranged to be engaged by the loops at the top surface of the water craft when the surfer assumes the most common upright supported position on the craft.

In accord with other aspects, however, one or more of the flexible components are fixed to a side surface of the foot piece and which is normally located at the instep side of the user's foot. Here, it has been found that the linear elements greatly assist the surfer in manipulating the craft under those circumstances where there is a shift of most of the body weight to one foot while the other foot is used to reach out and steady the craft through contact with the top surface thereof. Under such circumstances, the surfer often makes contact with the top surface of the craft at a position remote from the principal weight bearing foot by exerting pressure to steady the craft along the instep side of the other foot. The ability to avoid slipping at the point of contact with the side of the foot greatly expands the number and type of manuvers available to the surfer and substantially reduces the dangers associated therewith.

A general object of the invention is to provide improved safety features for surfboard-type water craft. Another object of the invention is to provide an improved foot piece for use with surfboard-type water craft. Yet another object is to provide a foot piece for use with surfboard-type water craft that are equipped with a component at their top surface which has an outwardly facing surface portion with a multitude of small, closely spaced, flexible loop elements. Yet another object is to provide a foot piece for use with surfboard-type water craft and which embodies safety features that not only reduce slippage on the water craft by the users thereof but which facilitate the relocation of the user's foot on the surface of the craft without encountering resistance to the withrawal of the foot piece from the surface of the craft during the relocation process. Still another object of the invention is to provide an improved foot piece for use by surfers and which expands the range of maneuvers that may be made by the surfer without undue foot slippage. Other objectives of the invention will be apparent from the forgoing and following detailed disclosure set forth herein.

BRIEF DESCRIPTION OF THE DRAWINGS

The novel features which are believed to be characteristic of the invention are set forth with particularity in the appended claims. The invention itself, however, both as to its organization and method of operation may best be understood by reference to the following description taken in connection with the accompanying drawings, in which:

DETAILED DESCRIPTION

The foregoing parts of the specification are incorporated herein by reference.

Figure 1:
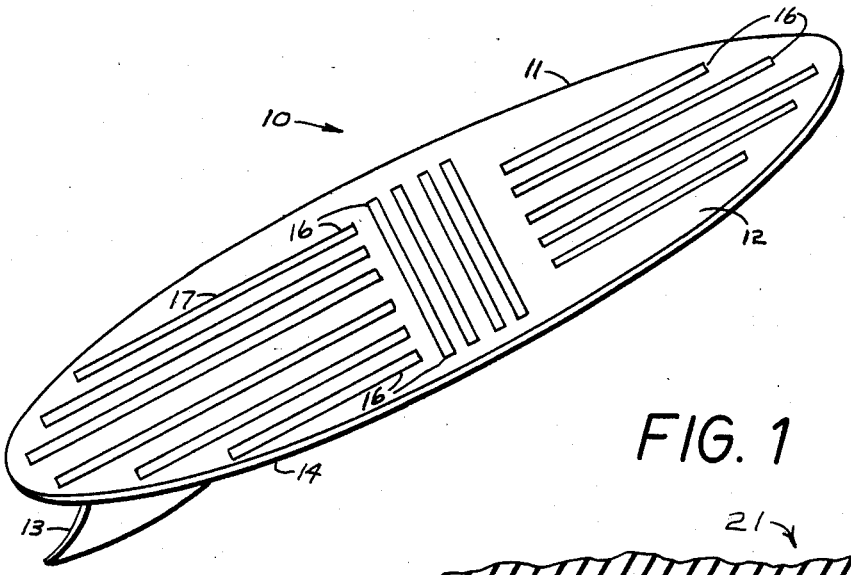
FIG. 1 is an isometric view of a surfboard-type water craft which is equipped along its top surface with a plurality of elongated, loop bearing, surface components.

Reference is now made to the drawings and more particularly to the surfboard-type water craft seen in FIG. 1 and wherein the craft is designated at 10. The surfboard 10 is of conventional construction and has a fiberglass reinforced outer shell 11 that is made of a suitable plastic material, such as one of the polyester resins. The constuction provides the craft 10 with a flat top surface 12 on which the surfer is supported during use of the craft and a suitable fin 13 at the bottom side 14 of the craft which serves as a stabilizer during use of the craft.

The top surface 12 of the surfboard 10 is equipped with a plurality of elongated strips 16 that are spaced apart and suitable fixed to the top surface 12. As exemplified by strip 17, each strip serves as a surface component in the structure of the water craft 10 and which has a generally planar, upwardly and outwardly facing surface portion 18 with a multitude of small, closely spaced, flexible loop elements 19. (FIGS. 1 and 4) These loop bearing strips or surface components 16 are preferably located throughout the top surface of the surfboard as seen in FIG. 1.

The surface components 16 are depicted as strip materials in the embodiment disclosed herein because, insofar as is known to the inventor, the loop bearing components are only available in the market place as elongated flexible strips of woven material in which the strands forming the loops are interlaced. The material is expensive and as a cost expedient, the strips may be suitable spaced apart on the surface 12 as shown in FIG. 1.

The strip-type surface components 16 may be applied to the surface 12 in any suitable manner that results in a secure adherance of each component to the top surface 12 of the craft and so that each component provides a generally planar outwardly and upwardly facing surface portion with the desired loop elements. In general the method used for adhering the strips 16 to the surface 12 will depend upon the character of the top surface and the materials used in the formation of the surfboard shell. In practice, a suitable plastic material that is polymerizable and capable of cross linking or otherwise interacting with the resinous material of the substrate may be applied to the underside of the strips. Thereafter the material is polymerized in the presence of a suitable catalyst and after the strips have been positioned on the surface of the craft so that a strong bond forms between the strips and the material of the substrate as the plastic material cures. An alternative method for applying the strips to the surfboard may be that disclosed in the aforementioned patent. Other methods for bonding the strips to the water craft will be apparent to those skilled in the art.

Figure 4:
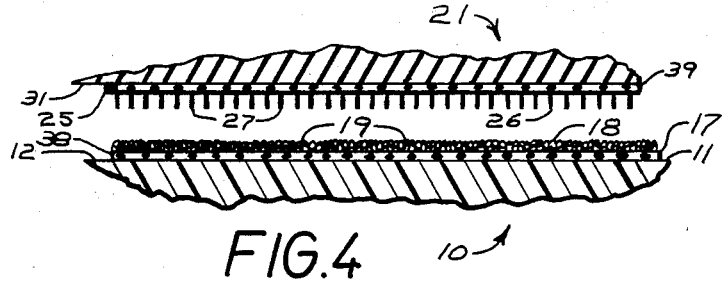
FIG. 4 is an enlarged sectional view showing a fragment of the two principal components involved in establishing the high resistance to slippage together with fragments of adjacent supporting structure on which the components are fixed, the view being such as to illustrate the general nature of the loop and linear elements and the relation of the surface components as their outwardly facing surface portions are brought to bear against one another.
Figure 3:
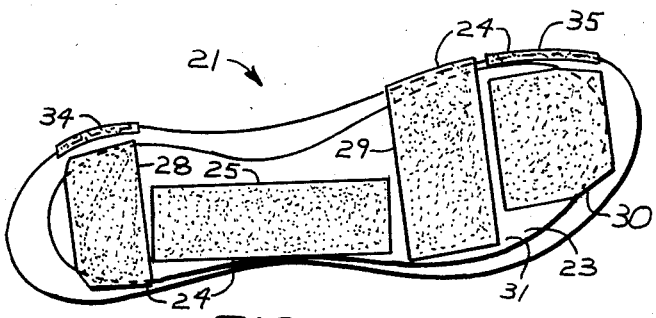
FIG. 3 is a bottom view of the foot piece shown in FIG. 2.
Figure 2:
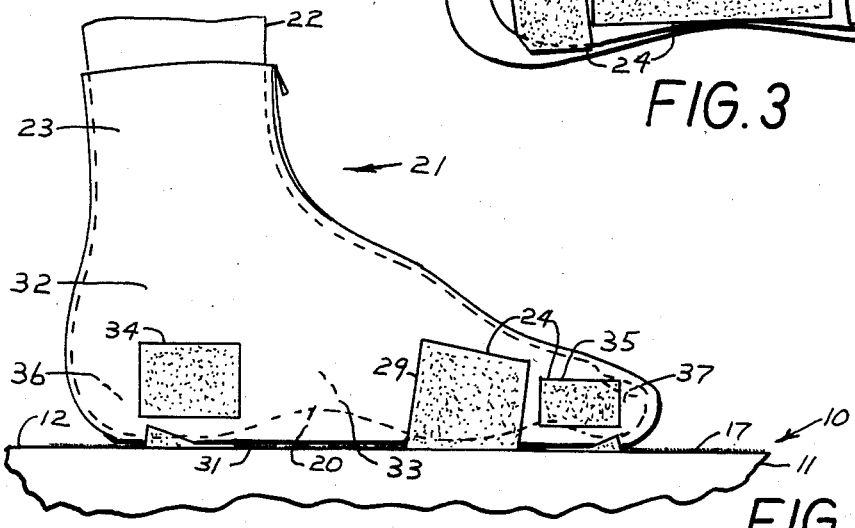
FIG. 2 is a side elevational view of a foot piece embodying certain principles of the invention and as seen when supported on the top surface of the surfboard seen in FIG. 1, the view being one at the instep side of the foot piece with a fragment of the adjacent structure of the surfboard being shown in section while a surfer's foot as received in the foot piece is shown in broken lines.

A foot piece which embodies certain aspects of the invention is best seen in FIGS. 2 and 3. The foot piece 21 show therein is made of rubber or other suitable flexible material commonly used in the construction of footwear for skin diver's wet suits. As seen therein, the foot piece is adapted to receive a surfboard user's foot 22 and has an outside surface 23 which is equipped with a plurality of flat strips 24 that are suitably fixed to the outside surface 23. Each strip provides a flexible surface component in the structure of the foot piece 21 and which, as exemplified by strip 25 is free of hook-type elements but nevertheless provided with an outwardly facing surface portion 26 with a multitude of small, stiff, closely spaced and outwardly projecting linear elements 27 (FIG. 4). Each of these linear elements has a substantially uniform diametric dimension throughout its entire outwardly projecting length.

Strips 25, 28, 29, and 30 (FIG. 3) are fixed to the bottom surface portion 31 of the outside surface 23 and this bottom surface 31, of course, normally underlies the sole 20 of the user's foot 22 as received in the foot piece. As such, each of the strips 25, 28, 29 and 30 serves as a linear element bearing surface component that is free of hook-type elements but with a downwardly facing surface portion which may be brought to bear against an upwardly facing loop bearing surface portion of one of the surface components 16 on the top surface 12 of the surfboard 12.

Strip 29 is elongated and in addition to being fixed to the bottom surface 31 of the foot piece 21 extends onto and is also fixed to a side surface portion 32 of the outside surface 23. This side surface portion 32 is located at the instep side 33 of a foot 22 received in the foot piece 21 as seen in FIG. 2. In addition to strip 29, the foot piece is also equipped with strips 34 and 35 on the side surface portion 32. Strip 34, as seen in FIG. 2, is fixed to the side surface 32 in an area in the proximity of the user's heel 36. Strip 35, on the other hand, is fixed to the side surface 32 in an area in the proximity of the user's large toe 37. Each of these strips 29, 34 and 35 also provides an outwardly facing surface portion which is free of hook-type elements, but nervertheless provided with a multitude of small, stiff, closely spaced and outwardly projection linear elements, such as illustrated by reference to strip component 25. However, in this case each of the strips 29, 34 and 35 provides a laterally facing surface portion with the linear elements while strip component 29 additionally provides a downwardly facing surface portion with the linear elements.

Strips of the linear element bearing components may be obtained from the manufactures of the hook- and loop-type fasteners heretofore referred to and they may be applied to the outer surface of the foot piece by conventional methods having regard for the materials used in the construction of the foot piece.

FIG. 4 depicts the foot piece 21 and surfboard 10 as the bottom surface 31 of the foot piece 21 is being brought down upon the top surface 12 of the surfboard. FIG. 4 more particularly depicts the relation of the linear element containing strip component 25 on the bottom surface 31 of the foot piece 21 to the loop containing strip component 17 on the top surface 12 of the surfboard as the outwardly facing surfaces 18 and 26 are brought together. When the downwardly facing surface 26 of component 25 is brought to bear against the upwardly facing surface 18 of strip component 17, the linear elements 27 of component 25 project downwardly into the loop elements 19 of component 17 and are oriented generally normal or perpendicular to the flat top surface 12 of the surfboard 10. As such, the linear elements 27 are engaged by the loop elements 19 when any attempt is made to move the foot piece laterally and in parallel with the top surface 12 of the surfboard 10 without prior withdrawal of the linear elements 27 from the upwardly facing surface 18 of the loop bearing component 17. This type engagement of the linear elements by the loop elements transpires wherever surface 26 bears against surface 18. By engaging the linear elements 27, the loop elements 19 of the surface component 17 fixed to the top surface 12 of the surfboard resist movements of the foot piece 21 in parallel with the flat top surface 12 but because of the generally straight and outwardly projecting nature of the linear elements 27, they exert substantially no resistance to the vertical withdrawal or separation of the foot piece 21 from the top surface 12. As such, the linear element bearing surface components in cooperation with the loop element bearing surface components on the surfboard materially increase the traction for the surfer on the top surface of the board without however interfering with the withdrawal and relocation of the foot piece on the surface of the board.

The linear element bearing surface components 34, 35 and 29 on the instep side of the foot piece assure the surfer of a secure foothold when exercising surfboard stabilizing manuvers which require the surfer to reach out with a foot to a point remote from the principal body weight bearing foot in order to exert a stabilizing force on the craft. Those skilled in the art will also recognize the freedom the surface component arrangement provides one in shifting forces being transmitted to the surfboard from the bottom surface of the foot piece to the instep side thereof.

A typical loop bearing component fixed to the top surface of the surfboard has a woven base of monofilament polyester or nylon material in which the loops are formed at the front side of the base by parallel monofilament strands that are interwoven with the warp and woof of the woven base as is known in the art. By way of example, the loop forming monofilament strands may be about 0.0022 in. in diameter, and the loops approximately 0.15 in. in length with a concentration at the loop side of the base of about 375 loops per sq. in. The filaments of the woven base are preferrably interlocked on the back side of the component by a coating of suitable plastic material that interconnects the woven strands in the base of the component and serves to resist withdrawal of the strands from the basic woven structure. The base portion of the surface component 17 fixed to the surface 12 of surfboard 10 is designated at 38 in FIG. 4.

A typical linear element bearing component fixed to the outside surface of the foot piece has a woven base of monofilament polyester or nylon material in which the linear elements are formed at the front side of the woven base and by way of example may have a diameter of about 0.0085 in., project outwardly from the woven base about 0.025 in. and may be present in a concentration of about 1000 elements per sq. in. In the manufacture of the components, the linear elements are derived from upright loops that are formed from monofilament strands that are interwoven with the woof and warf in the formation of the woven base structure of the component. The filaments of the base structure are interlocked by a coating of suitable plastic material on the back side of the component and the filaments of the upright loops are appropriately severed to provide a pair of outwardly projecting linear elements of the desired length for each loop. This results in each of the linear elements having a substantially uniform diametric dimension throughout its entire length of outward projection. The base portion of the surface component 25 fixed to the bottom surface 31 of the foot piece 21 is designated at 39 in FIG. 4. In practice, the linear elements are of sufficient stiffness to maintain a generally normal orientation with respect to the top surface of the surfboard and without appreciable deformation under the forces encountered during use.

While a preferred structure of the surface components has been set forth it will be apparent that such stuctures may be formed by other methods. Furthermore, although it is preferrable to avoid all resistance to withdrawal of the foot piece from the top surface of the surfboard in most instances, it is within the purview of the invention to utilize both surface components that have the linear element structure contemplated by the invention and surface components that have the hook elements characteristic of the fasteners heretofore mentioned on the foot pieces if desired.

While only a certain preferred embodiment of this invention has been shown and described by way of illustration, many modifications will occur to those skilled in the art and it is, therefore, desired that it be understood that it is intended in the appended claims to cover all such modifications as fall within the true spirit and scope of the invention.

What is claimed as new and what is desired to be secured by Letters Patent of the United States is:

1. An improved foot piece for use with a surfboard-type water craft that has a flat top surface which is equipped with a loop bearing surface component that is fixed thereto and has a generally planar outwardly and upwardly facing surface portion with a multitude of small, closely spaced, flexible loop elements, said foot piece being adapted to receive a surfboard user's foot and having a bottom surface which underlies the sole of a user's foot received thereby, said foot piece comprising a flat flexible surface component that is fixed to said bottom surface and has an outwardly and downwardly facing surface portion with a multitude of small, stiff, closely spaced and outwardly projecting linear elements, each of said linear elements have a substantially uniform diametric dimension throughout its entire outwardly projecting length, said linear elements being engagable by said loop element when said downwardly facing surface portion is brought to bear against said upwardly facing surface portion, said linear elements being generally straight and oriented generally normal to said top surface where said downwardly facing surface portion bears against said upwardly facing surface portion, and said outwardly and downwardly facing surface portion being free of hook-type elements that are engagable by said loop elements when said downwardly facing surface portion is brought to bear against said upwardly facing surface portion, whereby said loop bearing surface component resists movements of said foot piece in parallel with said top surface but avoids resistance to the withdrawal of said foot piece from said top surface when said linear elements are engaged by said loop elements.

2. An improved foot piece in accord with claim 1 wherein said foot piece has a side surface which is located at the instep side of a user's foot received thereby, said flexible surface component is also fixed to said side surface and has an outwardly and laterally facing surface portion with a multitude of small, stiff, closely spaced and outwardly projecting linear elements, each of said linear elements of said laterally facing surface portion having a substantially uniform diametric dimension throughout its entire outwardly projecting length, said linear elements of said laterally facing surface portion being engagable by said loop elements when said laterally facing surface portion is brought to bear against said upwardly facing surface portion, said linear elements of said laterally facing surface portion being generally straight and oriented generally normal to said top surface where said laterally facing surface portion bears against said upwardly facing surface portion, and said flat flexible surface component being free of hook-type elements that are engagable by said loop elements when said laterally facing surface portions is brought to bear against said upwardly facing surface portion.

3. An improved foot piece for use with a surfboard-type water craft that has a flat top surface which is equipped with a loop bearing surface component that is fixed thereto and has a generally planar outwardly and upwardly facing surface portion with a multitude of small, closely spaced, flexible loop elements, said foot piece being adapted to receive a surfboard user's foot and having a side surface which is located at the instep side of a user's foot received thereby, said foot piece comprising a flat flexible surface component that is fixed to said side surface and has an oputwardly and laterally facing surface portion with a multitude of small, stiff, closely spaced and outwardly projecting linear elements, each of said linear elements having a substantially uniform diametric dimension throughout its entire outwardly projecting length, said linear elements being engagable by said loop elements when said laterally facing surface portion is brought to bear against said upwardly facing surface portion, said linear elements being generally straight and oriented generally normal to said top surface where said laterally facing surface portion bears against said upwardly facing surface portion, and said flat flexible surface component being free of hook-type elements that are engagable by said loop elements when said laterally facing surface portion is brought to bear against said upwardly facing surface portion.

4. An improvd foot piece in accord with claim 3 wherein said flexible surface component is fixed to said side surface in an area in the proximity of the heel of a user's foot received by said foot piece.

5. An improved foot piece in accord with claim 3 wherein said flexible surface component is fixed to said side surface in an area in the proximity of the large toe of a user's foot received by said foot piece.

6. An improved foot piece for use with a surfboard-type water craft that has a flat top surface which is equipped with a loop bearing surface component that is fixed thereto and has a generally planar upwardly facing surface portion with a multitude of small, closely spaced, flexible loop elements, said foot piece being adapted to receive a surfboard user's foot and having an outside surface, said foot piece comprising a flat flexible surface component that is fixed to said outside surface and has an outwardly facing surface portion with a multitude of small stiff, closely spaced and outwardly projecting linear elements, each of said linear elements having a substantially uniform diametric dimension throughout its entire outwardly projecting length, said linear elements being engagable by said loop elements when said outwardly facing surface portion is brought to bear against said upwardly facing surface portion, said linear elements being generally straight and oriented generally normal to said top surface where said outwardly facing surface portion bears against said upwardly facing surface portion, and said flat flexible surface component being free of hook-type elements that are engagable by said loop elements when said outwardly facing surface portion is brought to bear against said upwardly facing surface portion.

7. The combination comprising a surfboard-type water craft having a flat top surface, a loop bearing surface component fixed to said top surface and having a generally planar upwardly facing surface portion with a multitude of small, closely spaced, flexible loop elements, a foot piece adapted to receive a surfboard user's foot and having an outside surface, a flat flexible surface component fixed to said outside surface and having an outwardly facing surface portion with a multitude of small, stiff, closely spaced and outwardly projecting linear elements, each of said linear elements having a substantially uniform diametric dimension throughout its entire outwardly projecting length, said linear elements being engagable by said loop elements when said outwardly facing surface portion is brought to bear against said upwardly facing surface portion, said linear elements being generally straight and oriented generally normal to said top surface where said outwardly facing surface portion bears against said upwardly facing surface portion, and said flat flexible surface component being free of hook-type elements that are engagable by said loop elements when said outwardly facing surface portion is brought to bear against said upwardly facing surface portion.

8. The combination in accord with claim 7 wherein said outside surface includes a bottom surface portion that underlies the sole of a user's foot received by said foot piece, and said flexible surface component is fixed to said bottom surface portion.

9. The combination in accord with claim 7 wherein said outside surface includes a side surface portion that is located at the instep side of a user's foot received by said foot piece, and said flexible surface component is fixed to said side surface portion.

10. The combination in accord with claim 7 wherein said outside surface includes a bottom surface portion which underlies the sole of a user's foot received by said foot piece and a side surface portion which is located at the instep side of a user's foot received by said foot piece, said flexible surface component is fixed to said bottom surface portion and said side surface portion.

* * * * *